United States Patent [19]

Peterson

[11] Patent Number: 4,887,397

[45] Date of Patent: Dec. 19, 1989

[54] FAST, ERECTABLE, EASILY TRANSPORTABLE STRUCTURES

[75] Inventor: John M. Peterson, Madison, Ala.

[73] Assignee: Teledyne Industries, Inc., Huntsville, Ala.

[21] Appl. No.: 259,481

[22] Filed: Oct. 19, 1988

Related U.S. Application Data

[63] Continuation of Ser. No. 66,926, Jun. 29, 1984, abandoned.

[51] Int. Cl.[4] ..... E04B 1/32

[52] U.S. Cl. ..... 52/86; 52/108

[58] Field of Search ..... 52/86, 108, 227

[56] References Cited

U.S. PATENT DOCUMENTS

| | | | |
|---|---|---|---|
| 3,857,213 | 12/1974 | Miyake | 52/86 |
| 3,925,943 | 12/1975 | Petrie | 52/108 |
| 3,940,892 | 3/1976 | Lindbergh | 52/86 |
| 3,973,370 | 8/1976 | McAllister | 52/86 X |
| 4,587,777 | 5/1986 | Vasques et al. | 52/108 |
| 4,593,710 | 6/1986 | Stafford et al. | 52/86 X |
| 4,651,480 | 3/1987 | Kramer | 52/108 |

FOREIGN PATENT DOCUMENTS

| | | | |
|---|---|---|---|
| 941466 | 11/1963 | United Kingdom | 52/86 |

*Primary Examiner*—David A. Scherbel

*Assistant Examiner*—Creighton Smith

*Attorney, Agent, or Firm*—Beveridge, DeGrandi & Weilacher

[57] ABSTRACT

A collapsible structural member including a plurality of segmental sections and devices for connecting adjacent segmental sections is disclosed. Each segmental section has a rigid, elongate body portion which terminates in end portions. The connecting devices connect the end portions of adjacent sections so as to define a maximal spacing between the adjacent end portions and to permit them to move between a maximum spaced apart realtionship and an abutting relationship. A quickly erectable shelter and a composite, collapsible support beam are also disclosed according to the present invention. The shelter has a flexible cover, at least one structural member including segmental sections for supporting the cover, connecting devices for connecting adjacent end portions of adjacent segmental sections, and a tensionable cable for moving the sections between a maximum spaced apart relationship and an abutting relationship defined by the connecting devices. The composite support beam includes at least two beam elements and at least one brace element for connecting the beam elements. Both the beam and brace elements have structural members adapted to assume a rigid, erect condition from a collapsed condition. Tensionable cables are provided for erecting the structural members.

26 Claims, 6 Drawing Sheets

FIG. 7
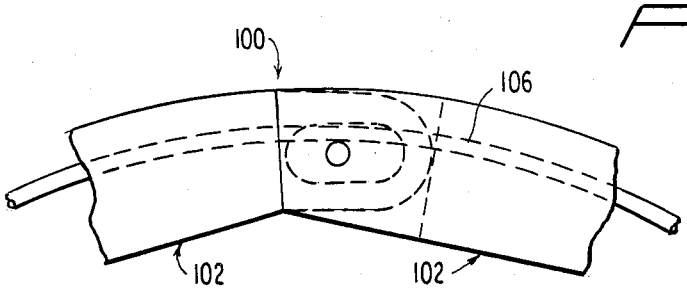
FIG. 4
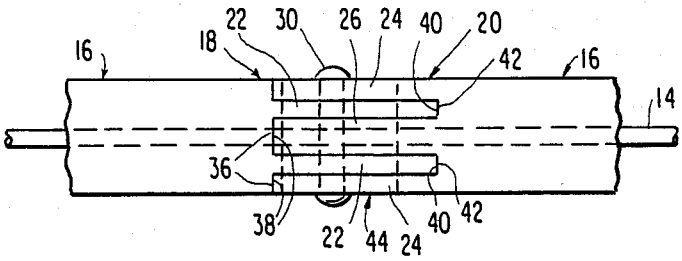
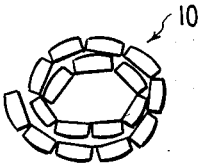
FIG. 5
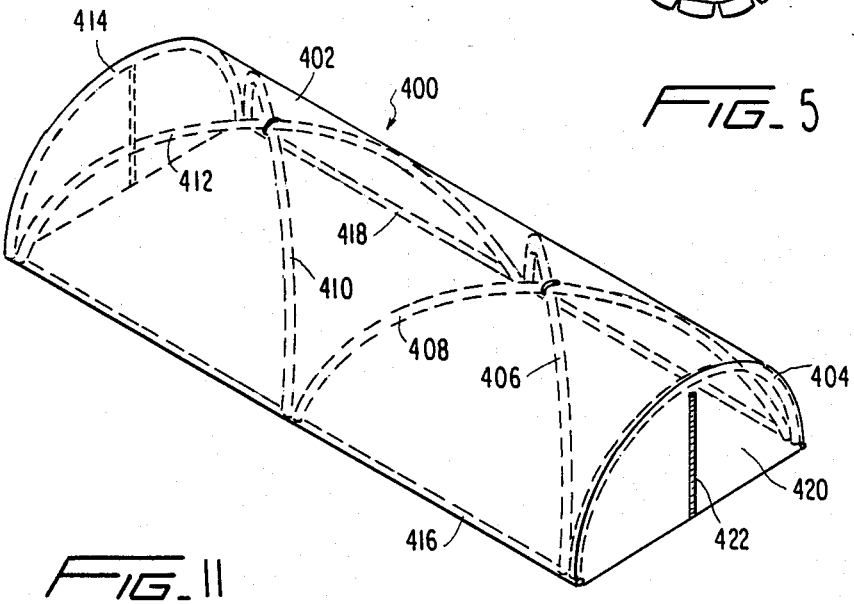
FIG. 11

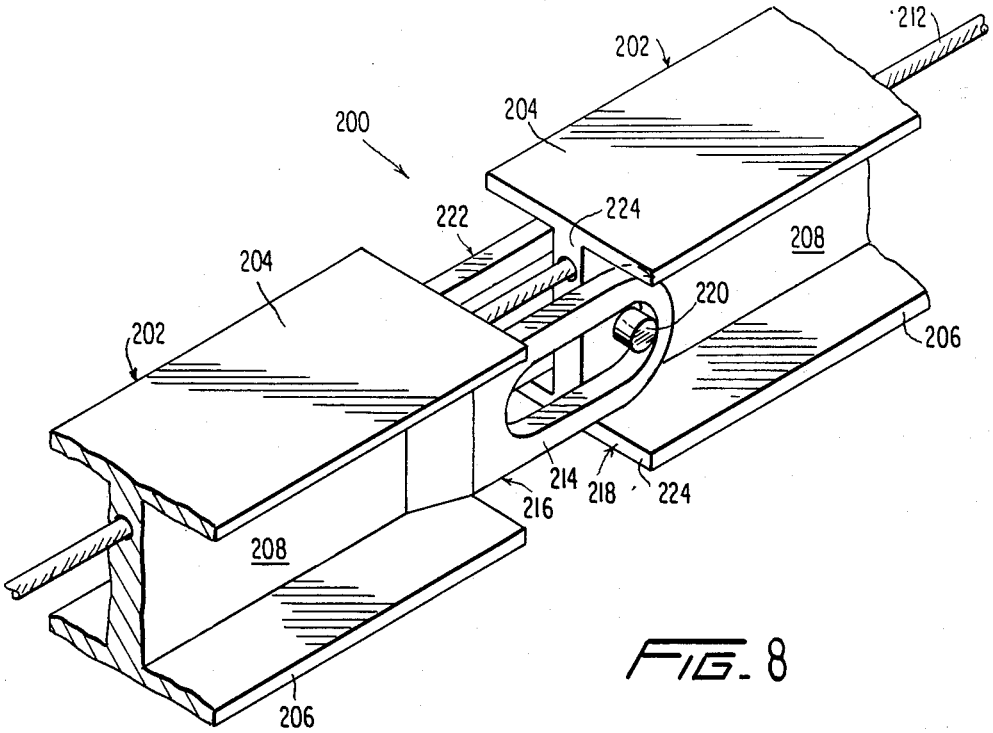
FIG. 8
FIG. 9
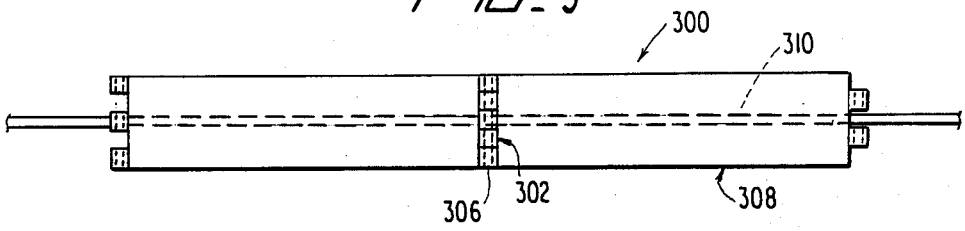
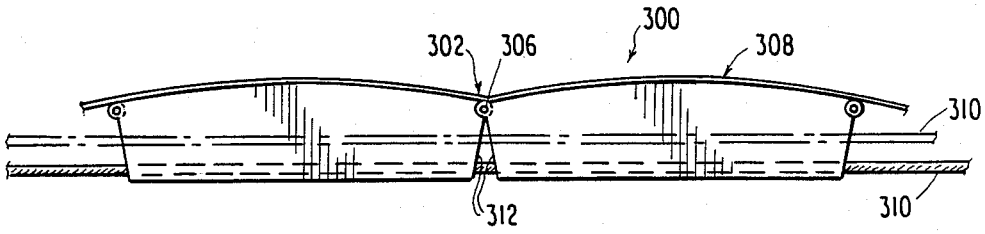
FIG. 10

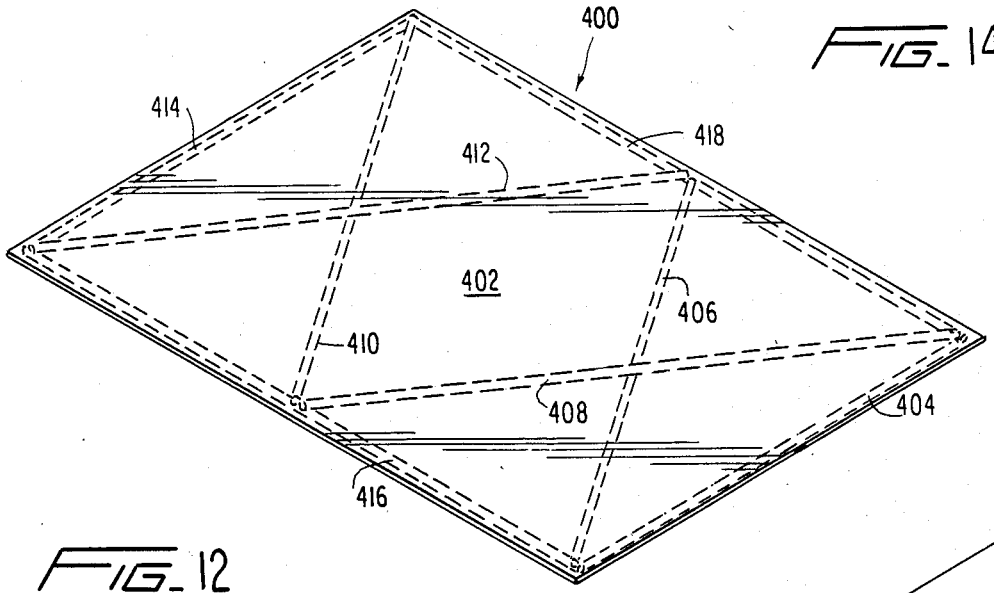
FIG. 14
FIG. 12
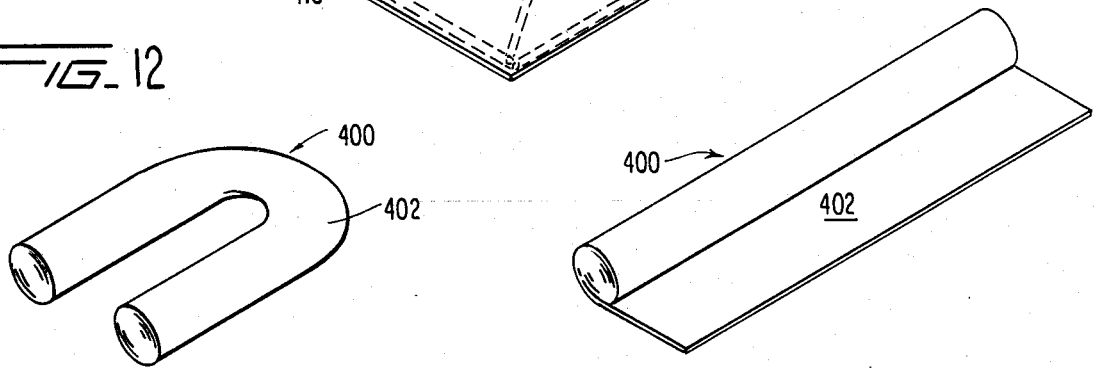
FIG. 13
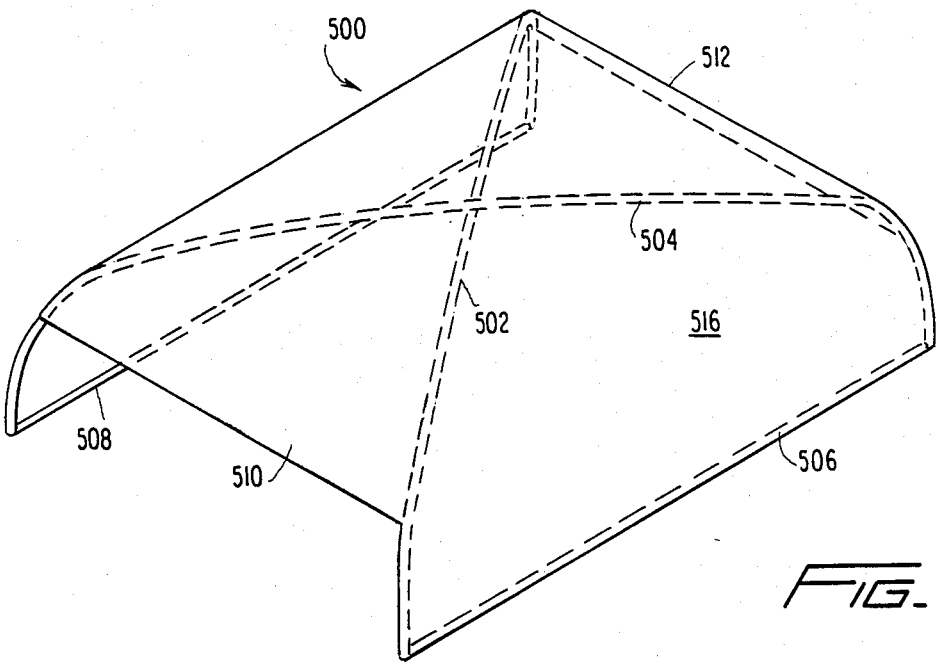
FIG. 15

FIG. 16
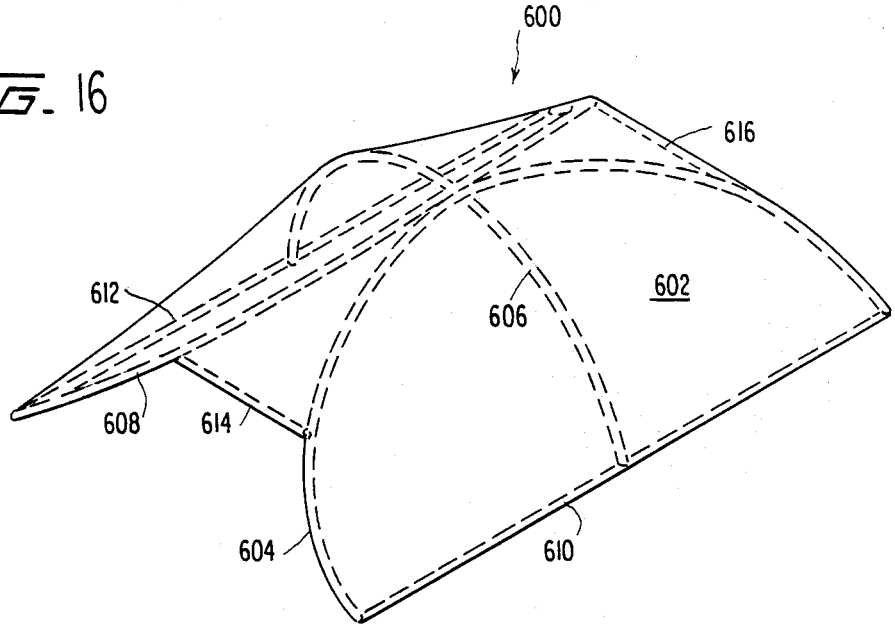
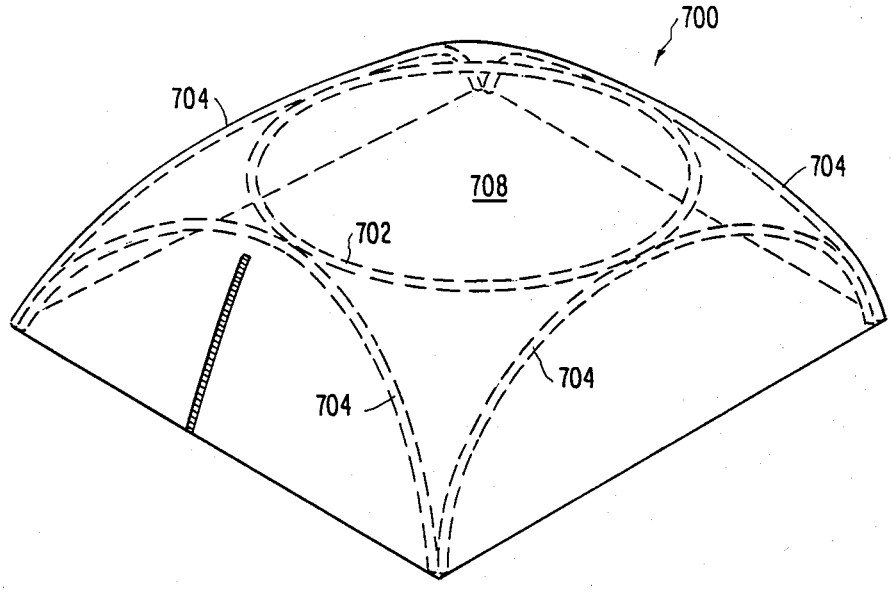
FIG. 17

FIG. 18
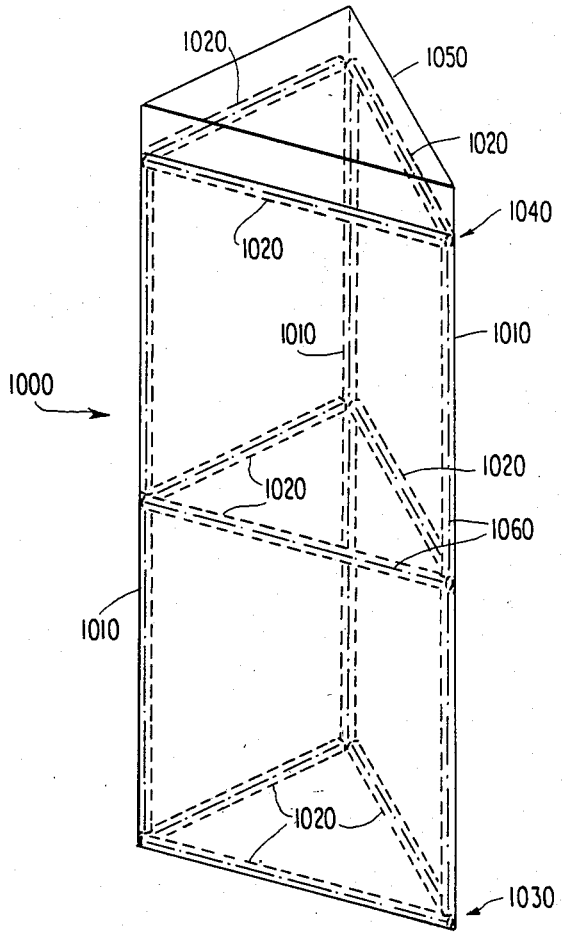
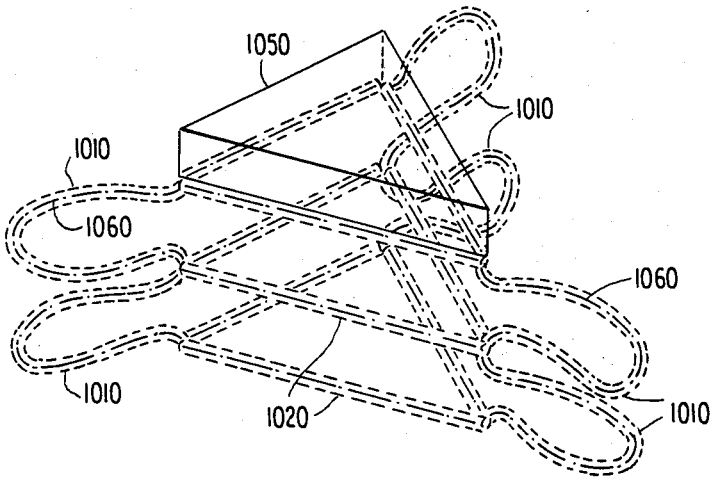
FIG. 19

FAST, ERECTABLE, EASILY TRANSPORTABLE STRUCTURES

This application is a continuation of application Ser. No. 066,926, filed 6-29-87 now abandoned.

BACKGROUND OF THE INVENTION

The present invention pertains to a collapsible, structural member comprising a plurality of rigid segmental sections and a tensionable cable for compressing the sections together to provide a rigid structural member. More particularly, the present invention pertains to a structural member having connecting means on the end portions of the segmental sections for permitting adjacent sections to move axially with respect to each other from a maximally spaced-apart relationship wherein the structural member can be coiled to an abutting relationship when the segmental sections are under compression by the tensioning cable wherein the structural member is made rigid.

The present invention also pertains to a portable, collapsible shelter comprising a flexible cover secured to a plurality of structural members according to the invention.

The present invention further pertains to a composite structural beam comprising a plurality of cooperating individual structural members according to the invention.

In constructing collapsible structural members, emphasis has been placed on providing members that may be assembled and disassembled rapidly to conserve time and labor. Equal emphasis also has been placed on providing collapsible members that will occupy less space when they are to be shipped and/or stored in their collapsed condition.

A knock-down structural member is known from U.S. Pat. No. 2,874,812 which shows a plurality of thin-walled sections linked in end-to-end relation by a tension cable. Each section is hermaphroditic and accordingly has a projection at one longitudinal end and a hollowed-out portion or boss at the other end. Both the projection and the boss portions have central apertures for accommodating a tension cable therethrough.

To form an arch, U.S. Pat. No. 2,874,812 discloses a spacer element provided between the adjacent sections. The spacer elements likewise have a central opening to accommodate the cable. Each spacer element also includes a first face portion having a boss for receiving the projection of one section and an opposite face portion having a projection for interfitting with the boss of the other adjacent section. The spacers are wedge-like to enable the same elemental sections employed in producing a straight structural member to be utilized with the same cable to form a curved arch member.

U.S. Pat. No. 4,284,094 to Behrend discloses a tent structure with support arches and a roof skin. Each support arch is composed of individual rigid arch elements comprising two parallel tubes held together by distance pieces. The distance pieces are constructed as interfitting half shells and tubular sections. In adjacent arch elements, the half shell of one arch element receives the tubular section of the other arch element. One bracing wire is received through each parallel tube to erect the arch.

In an alternative embodiment, the arch elements of U.S. Pat. No. 4,284,094 are connected by means including two opposing boxlike structures, one at each interfitting end of two adjacent arch elements. A rubber block provides an elastic buffer between the rigid arch elements. In still another embodiment, a pair of spiral springs provide spacing means for interconnecting the arch elements.

U.S. Pat. Nos. 1,509,881; 2,345,377; 2,574,241; 3,006 670; 3,122,152; 3,150,670; 3,708,944; 3,857,213; 3,973,370; 4,140,141; and 4,152,875 disclose various other collapsible structures or structures having members held together by cables or the like.

SUMMARY OF THE INVENTION

A preferred collapsible structural member according to the present invention is adapted to assume either an untensioned or slack condition wherein the member can be coiled for storage or transportation, or a tensioned, compressed state wherein the member provides a rigid building component. The structural member comprises a plurality of segmental sections with each of such sections including an elongate body portion that terminates in opposed end portions. The body portion has a longitudinally extending opening therethrough for accommodating a tension cable.

Connecting means are provided on the end portions of the sections to arrange them in end-to-end relation. The connecting means permanently connects or links the segmental sections together in such a way that the connected end portions are free to move between a maximum spaced-apart relationship, wherein the adjacent end portions can pivot with respect to each other, and an abutting relationship wherein the adjacent end portions are fixed with respect to each other. Tensioning of the cable compresses the sections to move them into their end-to-end abutting relationship to rigidly erect the structural member. Each segmental section is automatically aligned to move into abutting relationship by the connecting means.

In an alternative embodiment of a structural member according to the present invention, likewise adapted to assume an untensioned state enabling the member to be coiled and a tensioned state, the plurality of segmental sections have a body portion, a cable through the sections and hinges connecting adjacent sections. The hinges connect adjacent end portions of adjacent sections so as to permit the sections to pivot with respect to each other when the structural member is in the uncompressed, slack state.

Further according to the present invention, a quickly erectable shelter comprises a flexible cover and a plurality of structural members comprising segmental sections in accordance with the invention to support the cover. The structural members are provided with a tensionable cable for compressing the segmental sections to erect each member. The members likewise include connecting means, provided on the end portions of adjacent segmental sections to guide the sections into end-to-end rigid abutment. The connecting means likewise continues to link the sections when the cables are untensioned to permit each of the structural members of the shelter and therefore the shelter itself to be rolled up for storage and/or transportation.

Still further according to the present invention, a composite collapsible support beam is disclosed. The support beam is adapted to be erectable from an untensioned, slack state to a rigid, compressed condition. The beam comprises beam components or elements arranged in parallel and brace elements or components for connecting the beam elements to form the composite support beam. Preferably, each of the beams and the braces comprises a structural member having segmental sections linked by connecting means according to the present invention.

BRIEF DESCRIPTION OF THE DRAWINGS

These and other features and aspects of the present invention are more apparent from the following detailed description and claims, particularly when considered in conjunction with the accompanying drawings in which like parts bear like reference numerals. In the drawings:

FIG. 4 is an enlarged, downwardly directed view of portions of two adjacent segmental sections of the structural member of FIG. 1 in abutting, locked relationship;

FIG. 5 depicts a structural member according to-the present invention wherein the member is coiled for storage or transportation purposes;

FIG. 7 depicts the adjacent end portions of the structural member portion shown in FIG. 6 in abutting, locked relation;

FIG. 8 is an enlarged, perspective view of portions of another embodiment of a structural member according to the present invention;

FIG. 9 is a downwardly directed view of portions of still another embodiment of a structural member in accordance with the present invention;

FIG. 10 is a front elevational view of the portions of the structural member of FIG. 9;

FIGS. 11, 12, 13 and 14 are perspective views of a first embodiment of a quickly erectable shelter according to the present invention wherein the shelter is depicted as fully erected, fully rolled-up for storage or transport, partially unrolled and unrolled but collapsed, respectively;

FIG. 15 is a perspective view of a first alternative embodiment of a quickly erectable shelter comprising two structural members providing arches and two structural members comprising beams in accordance with the present invention;

FIGS. 16 and 17 are perspective views of still other embodiments of a quickly erectable shelter according to the present invention;

FIG. 18 is a perspective view of a composite, collapsible beam having beam and brace elements according to the present invention; and FIG. 19 is a perspective view of the composite, collapsible beam of FIG. 18 in a collapsed condition.

DETAILED DESCRIPTION OF THE INVENTION

Figure 1:
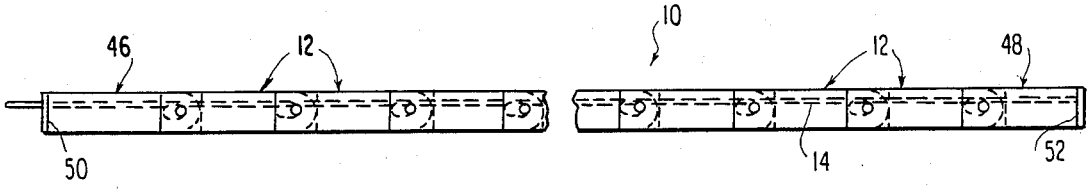
FIG. 1 is a front elevational view of a structural member providing a beam, pillar, pole or the like in accordance with the present invention.

FIG. 1 is a side elevational view of a collapsible, supporting structural member 10 according to a preferred embodiment of the present invention. Structural member 10 is adapted to serve as a beam, rafter or the like when oriented horizontally as in FIG. 1, or to serve as a pole, column or the like when oriented vertically. Alternatively, as will be discussed further in the following with reference to FIG. 2, the structural member, identified by 100 in the latter drawing, may have any desired curvature to provide a rigid arch.

Figure 3:
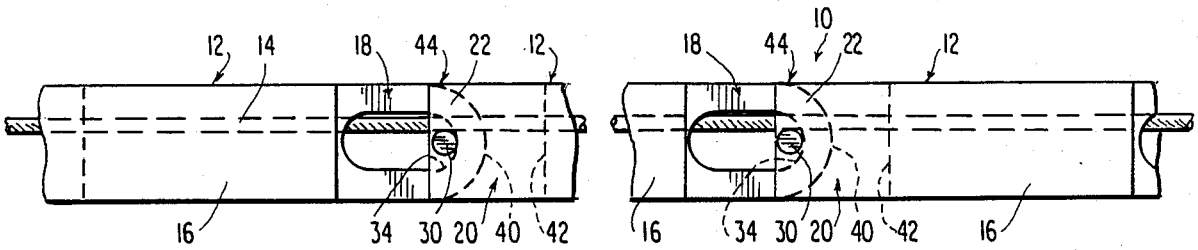
FIG. 3 is an enlarged view of a portion of the structural member of FIG. 1.

As seen from FIGS. 1 and 3, structural member 10 comprises a plurality of rigid, segmental sections 12 arranged in end-to-end relation. Any desired number of sections 12 may be employed to provide a structural member 10 of any desired length. Each of sections 12 is under compressional force, effected by the tensioned cable 14, to provide rigidity for structural member 10.

FIGS. 3 and 4 depict fragmentary parts of the segmental sections 12 making up the structural member of FIG. 1. In FIG. 3, the cable 14 is untensioned whereby the three sections 12 are shown on an uncompressed state. Each section 12 comprises a main body portion 16 and two opposing end portions indicated by reference numerals 18 and 20 in the Figures. Main body portion 16 can be tubular or, as is likewise apparent to those of ordinary skill in the art, can be substantially solid except for a through passage for receiving cable 14. End portion 18 which, for convenience, hereinafter could be referred to as the male end portion, is integral with or otherwise permanently attached to main body portion 16. As seen from both FIG. 3 and FIG. 4, which is a downwardly directed view at the connection of two adjoining sections 12, male end portion 18 comprises a pair of parallel, spaced-apart eyelet portions 22. Each eyelet portion 22 has an eccentrically shaped opening for reasons to be discussed in the following.

Corresponding end portion 20, referred to as the female end portion, is arranged to provide locking engagement with the male end portion of an adjacent segmental section 12. Again, with particular reference to FIG. 4, female end portion 20 comprising outer wall portions 24 thus defines two parallel slots 28 adapted to fully receive each of eyelets 22 therein. A stop 30 extends transversely through outer wall portions 24, slots 28 and a central partition 26 as well as through eyelets 22 to link the end portions of each of the segments in chain-like, end-to-end relation and thereby prevent complete disengagement between the male end portion of one section and the female end portion of the adjacent section. As is apparent to those of ordinary skill in the art, stop 30 could comprise a rivet, a bolt with a lock nut or like means for securing end 18 with respect to the end 20 of the next, adjacent section.

The linking arrangement of eyelets 22 and stop 30 determines a maximal longitudinal spacing between each of the connected adjacent segmental sections 12. When sections 12 are in their fully extended or maximally spaced-apart position, stop 30 contacts the forward inner wall 34 of eyelets 22. In this way, the adjacent sections 12 are free to swing or pivot with respect to each other about an axis defined by stop 30. Further, the sections 12 are axially movable with respect to each other from their fully extended or maximally spaced-apart position to a fully compressed or locked position wherein the sections are immobile with respect to each other. In the compressed or locked position, base 36 of male end 18 abuts with flat contacting faces 38 of the female end outer wall portions 24 and the female end central partition 26. Likewise, the forwardmost ends or noses 40 of eyelet portions 22 abut against two flat contacting faces 42 of the female end portion 20. In their compressed or abutting position as determined by compression cable 14, male and female end portions 18 and 20 are substantially immovable with respect to each other to provide a rigid structural member 10.

Adjacent end portions 18 and 20 having eyelets 22, slots 28 and abutting surfaces 36, 38, 40 and 42 are thus provided with connecting means generally identified by reference numeral 44 for linking the plural segmental sections 12 together in chain-like, end-to-end relation when cable 14 is untensioned, and rigid, abutting, end-to-end relation when the cable is under tension. By means of eyelet portions 22 and stop 30 extending therethrough, connecting means 44 defines a position of maximum separation between the flat contacting or compression faces on each of end portions 18 and 20 whereby the adjacent sections 12 are pivotable with respect to each other. When the adjacent end portions 18 and 20 of all of the segmental sections are maximally separated, the combined pivotal movement of all of its segmented sections 12 permits the composite structural member 10 to be coiled as shown in FIG. 5. Structural member 10 thus compactly coils to facilitate transportation and storage thereof. Due to permanent linkage between the end portions of each of the adjacent sections by connecting means 44, all of the segmental sections 12 remain connected in an end-to-end relationship regardless of whether cable 14 is tensioned, or in a slack condition.

Since adjacent end portions 12 are interlinked by connecting means 44, as cable 14 is tensioned, contact surfaces 36 and 38 and 40 and 42 are automatically aligned and brought into abutting contact. Connecting means 44 prevents transverse movement of the adjacent sections 12 to ensure that structural member 10 will be erected merely by applying tension to cable 14 without need for manually or otherwise aligning the adjacent sections for proper abutment.

In FIG. 1, the majority of segmental sections 12 are hermaphroditic as described above. Two segmental sections, 46 and 48, however, form the opposing ends of structural member 10. Each of segmental sections 46 and 48 has an end plate 50 and 52, respectively. Cable 14 terminates at end plate 52 in any connective way apparent to those of ordinary skill in the art whereby plate 52 anchors one end of the cable for the purposes of tensioning the cable. On the other hand, cable 14 extends through end plate 50 whereby it is accessible to conventional means for providing tension on it. In this way, segmental sections 46 and 48 terminate structural member 10 to determine the axial length of the member.

Figure 6:
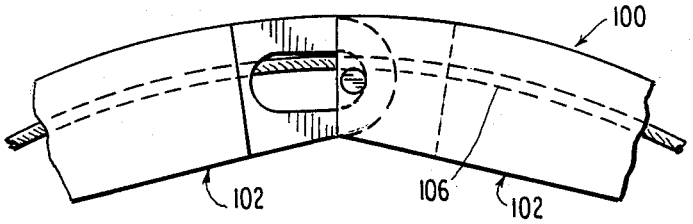
FIG. 6 is a side view, similar to FIG. 3 of a portion of the structural member of FIG. 2.

FIGS. 6 and 7 are enlarged views of a portion of a first alternative embodiment of a structural member 100 according to the present invention. In FIGS. 6 and 7, segmental sections 102 are arcuate rather than straight to provide a structural member having a predetermined curvature. Otherwise, sections 102 are identical to segmental sections 12.

Figure 2:
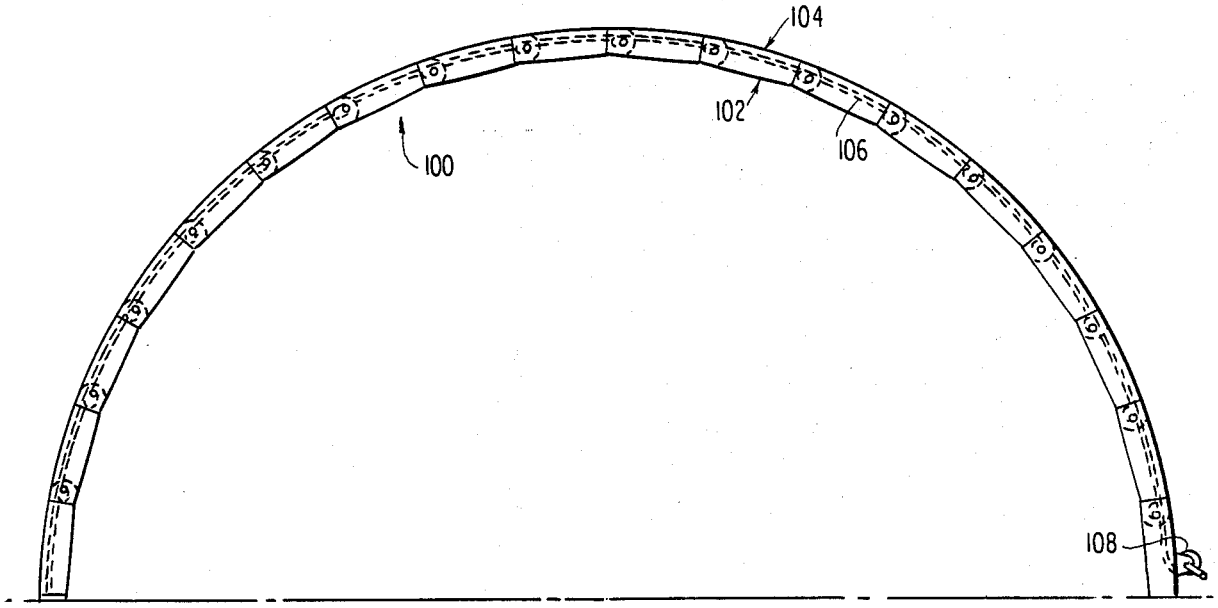
FIG. 2 is a front elevational view of a first alternative embodiment of a structural member according to the present invention wherein the member is adapted to provide a rigid arch.

Arch 104, depicted in FIG. 2, comprises structural member 100 made up of arcuate segmental sections 102 and a tension cable 106 for compressing the sections 102. Arch 104 is illustrated as being anchored to the ground in any known way. Arch 104 is provided with a hand crank 108 on one of segments 102 for coiling cable 106 until all slack is taken up and the cable is fully tensioned. Crank 108 locks to maintain tension on cable 106. Alternatively, rather than the hand-operated crank 108, arch 104 could comprise a powered winch, or the like, for coiling cable 106 upon a spindle to tension the cable.

FIG. 8 is a fragmentary view of still another structural member 200 according to the present invention. Again, as understood by those skilled in the art, the composite structural member 200 can be made up of any number of segmental sections 202 while only portions of two such sections are shown.

Segmental sections 202 are configured as I-beams having upper and lower rail portions 204 and 206 connected by web portion 208. Web portion 208 has an opening 210 extending longitudinally therethrough for accommodating tension cable 212. Eyelets 214 are provided as forwardly projecting flanges on both sides of web portion 208 to define a male end portion 216. Eyelets 214 are thus spaced apart by web portion 208 to receive the web portion of the female end portion 218 of the adjacent section. Eyelets 214 likewise have elongate or eccentric openings through which a stop member 220 extends for interlinking the segmental sections in chain-like, end-to-end fashion and permitting the sections 202 of the resulting structural member 200 to axially move between a maximally spaced-apart and an abutting relationship. The end portions 216 and 218 of the adjacent sections 202 are thus likewise provided with connecting means, referred to as connecting means 222 for interlinking the adjacent sections. Connecting means 222 likewise permits each segmental section to freely pivot with respect to the others to enable coiling of structural member 200. To permit the freedom of movement, the height of each eyelet 214 is slightly less than the height of web portion 208. Thus, when segmental sections 202 are in their maximally separated position, sufficient pivotal movement between the sections is assured.

Upon tensioning of cable 212 sections 202 similarly are guided into abutting contact by connecting means 222. In particular, the I-shaped end or contact face 224 of each segment 202 is pressed against that of the adjacent segment by cable 212. It is this compressed abutment due to the compression applied by cable 212 that prevents axial movement between the two abutting sections.

As is understood by those skilled in the art, each segmental section 202 likewise can have any particular curvature to produce an arch-shaped structural member. Accordingly, contact faces 224 would be beveled to accommodate for the desired curvature to ensure full face-to-face abutment therebetween.

A portion of yet another embodiment of a structural member 300 according to the present invention is shown in FIGS. 9 and 10. Structural member 300 differs from the previously discussed structural members in that the connecting means 302, connecting each of segmental sections 304 together in end-to-end relation, comprises hinges 306. Otherwise, segmental sections 304 have a main body portion 308 accommodating tensionable cables 310 therethrough. Similarly, body portion 308 terminates in opposing end portions having compression faces 312 thereon. In preferred structural member 300, two cables 310 are provided for added strength; however, as one of ordinary skill in the art appreciates, member 300 can be provided with only one cable as well.

Hinges 306 likewise permit each of contact or compression faces 312 to pivot between a position wherein they are maximally spaced from each other and a postion wherein they abut or contact each other. When cables 310 are untensioned, each segmental section 304 is likewise free to pivot with respect to its adjacent segment whereby the resulting structural member 300 also can be rolled or coiled for transportation and/or storage purposes. As cables 310 are fully tensioned, due to the pivot action of hinges 306, contact faces 312 move further toward abutment, along the arrows in FIG. 10 until they are pressed against each other. Thus, hinges 306, like the connecting means of the structural members disclosed infra, maintain each segmental section in connected, end-to-end relation to properly guide and align the sections as cables 310 are tensioned to ensure quick erection of structural member 300 without need for special alignment of any of the segmental sections. As can be seen from FIG. 10, since contact faces 312 are angled, the erected structural member 300 will have a curvature corresponding to the bevel of the contact surfaces.

As is now evident to one of ordinary skill in the subject art, the segmental sections of the preferred structural member can have any suitable cross-sectional shape. Further, the segmental sections of each of the aforedescribed structural members, 10, 100, 200 and 300 can be of any longitudinal length depending on the desired diameter of the coil when such structural members are rolled up. Where the structural members are to be employed in quickly erectable tent or tent-type structures, the segmental sections may conveniently be one to three inches long. This will ensure that when untensioned to collapse, the structural members can be rolled into relatively small coils. On the other hand, where the structural members according to the present invention are used in large collapsible shelters, such as warehouse shelters or the like, the segmental sections could have lengths of perhaps three to six feet.

Preferably, the disclosed structural members are fabricated from a high strength plastic. Alternatively, the segmental sections of the members could be constructed from metal. Likewise, the tensioning compression cables may be fabricated from a tough nylon or fiberglass material or could simply comprise steel cable. Where the segmental sections consisted entirely of plastic and the cables of a fiberglass or nylon material, the structure supported by such structural members would be substantially invisible to radar and thus be suitable for application as military camouflaged shelters.

Portable, knock-down shelter 400 (FIG. 11) according to the present invention utilizes collapsible structural members of the general type shown in any of FIGS. 1-10. With reference to FIGS. 11–14, shelter 400 comprises a cover material 402 secured over a plurality of structural members 404, 406, 408, 410, 412, 414, 416, and 418. Cover 402 could comprise fiberglass, a metal, or indeed any conventional fabric such as tent material to provide shelter from the elements.

Shelter 400 is shown in its collapsed form in FIGS. 12–14. FIG. 12 generally depicts shelter 400, including all of its structural members and their respective tension cables as rolled up and folded over for transportation for example on a pallet. In FIG. 3, shelter 400 is depicted as unfolded and partially unrolled. Shelter 400 is seen in a fully unrolled, collapsed state prior to erection in FIG. 14. At this time each of the tension cables is untensioned, however, all of individual segmental sections making up structural members 404–418 are interlinked by their respective connecting means whereby mere tensioning of their respective cables will automatically guide the segmental sections into abutment to erect the structural elements and therefore the shelter 400. Cover 402 is attached over structural members 404–418 and thus properly positions all of the members for erection of the shelter 400.

By way of example, shelter 400 is erected by first tensioning structural members 416 and 418 to provide two parallel beams extending for the longitudinal length of the shelter. Next, arched structural member 404 is tensioned. Transverse arches 406, 408, 410 and 412 are successively tensioned and finally opposite end arch 414 is tensioned to completely erect shelter 400. Arches 406 and 408, and 410 and 412 cross in an under-over relationship. Alternatively, as is evident to those skilled in the art, interconnecting means could be provided for each crossing pair of arched structural members at their intersection. Shelter 400, so constructed, thereafter can be anchored to the ground by a combination of cables, ropes, spikes and the like. End covers 420 with means for egress 422 into shelter 400 are also shown in FIG. 11 as attached to the shelter in any conventional way. The foregoing exemplary sequence of steps of erecting shelter 400 is simply reversed to collapse and roll up the shelter.

Shelter 400 is ideally suited to provide a quickly erectable quonset-type building for inhabitants or cover for trucks, tractors or the like. Where structure 400 is employed as personnel housing in a military environment, cover material 402, providing a roof skin, preferably is given camouflage coloration to disguise the structure. Most preferably, where structure 400 is employed as a camouflaged shelter in military applications, each of structural members 404–418 is fabricated from a plastic material. As previously discussed, the cables for tensioning the structural members would be fabricated from fiberglass so that the resulting camouflaged shelters would be substantially invisible to radar or like electronic surveillance.

A first alternate embodiment of a shelter 500 according to the present invention is shown in FIG. 15. Shelter 500 requires only two crossing arches 502 and 504 and opposing side beams 506 and 508. Preferably, arches 502 and 504 and beams 506, 508 likewise comprise segmental sections having connecting means in accordance with the present invention. The connecting means of structural members 502, 504, 506 and 508 provide sufficient spacing between the end portions of the structural member segmental sections to enable roll-up of the collapsed shelter 500 when the cables are untensioned. In the same way, the connecting means aligns all the interlinking, adjacent segmental sections for facilitated erection of the shelter. Substantial rigidity is provided for sides 510 and 512, without structural members by means of heavy seams in the cover material 516.

FIGS. 16 and 17 depict two further embodiments of portable shelters according to the present invention. In the embodiment of FIG. 16, shelter 600 comprises a cover 602 supported by three structural members 604, 606 and 608 configured as arches. Four additional structural members 610, 612, 614 and 618 are arranged as beams. Members 610 and 612 provide a base for the shelter 600 while beam members 614 and 616 define ports. Arched members 604, 606 and 608 are connected to base members 610, 612, 614 and 616 in any conventional way.

With reference to FIG. 17, portable shelter 700 includes a circular structural member 702 defining the roof of the shelter. Four identical arch-shaped structural members 704 according to the present invention form the sides of the shelter. A cover 708 is attached to members 702, 704 and 706 to complete the enclosure.

The structural members in both shelters 600 and 700 likewise allow roll-up of the collapsed structure for transportation and storage.

Due to their coiling and uncoiling, and self-aligning capability, structural members according to the present invention, particularly the I-bēam arrangement of FIG. 8, are ideally suited for use in space. The structural members can be coiled for efficient storage on a space shuttle for example and then be erected by tensioning their respective cables when the destination is reached.

FIG. 18 shows a preferred form of a composite, collapsible structural beam 1000 ideally suited for use in space applications such as in constructing a space station, for example. Composite beam 1000 comprises at least three beam elements 1010 secured in parallel, spaced alignment by three triangular arrangements of three brace elements 1020 at the longitudinal ends 1030 and 1040 and at approximately the middle of beam 1000. Each of beam elements 1010 and brace elements 1020 comprises a structural member which in turn comprises a plurality of segmental sections connected in end-to-end relation by connecting means according to the present invention and a compression cable 1060. Beam elements 1010 and brace elements 1030 are connected in any conventional way apparent to those skilled in the subject art. As an example, the respective tension cable 1060 of each beam or brace element could be secured to the cables of the adjoining elements.

One skilled in the art would also appreciate that other than being configured as a prism with three beam elements and nine brace elements, composite beam 1000 could have a rectangular shape with four beam elements and eight brace elements, for instance, or could have any other shape providing the necessary strength. Moreover, any number of brace elements may be employed to interconnect the beam element depending on strength requirements for the composite structural beam.

A mass 1050 is shown as attached to longitudinal end 1040. Mass 1050 comprises metal, steel or any other heavy material characterized by a large momentum when placed in motion. So arranged on composite beam 1000, mass 1050 provides means for extending all of the structural members making up the beam where the space craft carrying the beam is in orbit about the earth. To erect beam 1000 using the momentum of mass 1050, opposite end 1030 of this composite beam first is temporarily anchored to the craft. Due to the angular motion of the craft and thus the free end 1040 of composite beam 1000, the free end and mass 1050 move outwardly until all of the structural members forming beam 1000 are fully extended whereby the mass moves perpendicular to the orbital direction of the spacecraft. Next, the tension cable 1060 of each structural member is tensioned to compress the segmental sections of each of the various structural members and give rigidity to the composite beam. Once the cables 1060 are pulled taut to erect composite beam 1000, the cables are secured to ensure that the beam remains rigid.

Composite, collapsible beam 1000 is shown in collapsed condition in FIG. 19.

Although the present invention has been described with reference to a preferred embodiment, numerous modifications, rearrangements, and substitutions could be made and the result would remain well within the scope of the invention.

What is claimed is:

1. A collapsible structural member comprising:

a plurality of segmental sections adapted for longitudinal movement with respect to each other on a tensionable cable between a maximum spaced apart relationship and an abutting relationship wherein said segmental sections provide rigidity for said structural member, each of said segmental sections having a rigid, elongate body portion terminating in end portions in a longitudinal direction; and means on said end portions for connecting an end portion of one of said segmental sections with the adjacent end portion of an adjacent said segmental section, said connecting means including first means for preventing said longitudinal movement of said connected adjacent end portions beyond said maximum spaced apart relationship and second means for permitting movement of said connected adjacent end portions between said maximum spaced apart relationship and said abutting relationship.

2. A structural member as claimed in claim 1, wherein said connecting means is formed to connect said adjacent end portions together in chain-like, end-to-end relation.

3. A structural member as claimed in claim 2, further comprising a tensionable cable, extending axially through each of said segmental sections, for moving said end portions from said maximum spaced apart relationship to said abutting relationship, whereby said structural member is rigid.

4. A structural member as claimed in claim 2, wherein said permitting means comprises an eyelet, having an eccentric opening, on one end portions of each pair of adjacent end portions, and said preventing means comprises stop means, received by said eyelet, on the other end portion of each of said pairs of end portions.

5. A structural member as claimed in claim 2, wherein said connecting means permits relative pivotal movement of said connected adjacent end portions when said segmental sections are in said maximum spaced apart relationship.

6. A structural member as claimed in claim 2, wherein said body portions are rounded.

7. A structural member as claimed in claim 2, wherein said body portions are formed as I-beams.

8. A structural member as claimed in claim 2, wherein said body portions have a predetermined curvature.

9. A collapsible structural member comprising:

a plurality of segmental sections adapted for movement with respect to each other on a tensionable cable between a maximum spaced apart relationship and an abutting relationship wherein said segmental sections provide rigidity for said structural member, each of said segmental sections having a rigid, elongate body portion terminating in end portions; and connecting means comprising a hinge for connecting an end portion of one of said segmental sections with the adjacent end portion of an adjacent said segmental section, said hinge preventing said adjacent end portions from moving beyond said maximum spaced apart relationship and permitting said adjacent end portions to move between said maximum spaced apart relationship and said abutting relationship.

10. A quickly erectable shelter comprising:

a flexible cover for providing an enclosure;

at least one structural member for supporting said cover over the area to be enclosed, said at least one structural member including a plurality of segmental sections each having a body portion terminating in opposing end portions in a longitudinal direction, each said body portion having an axially extending opening therethrough;

a tensionable cable received through said opening through said segmental sections, said segmental sections being movable with respect to each other on said cable between a maximum spaced apart relationship and an abutting relationship to erect said at least one structural member;

connecting means on said end portions for connecting adjacent end portions of adjacent segmental sections, said connecting means including first means for preventing longitudinal movement of said connected adjacent end portions beyond said maximum spaced apart relationship and second means for permitting movement of said connected adjacent end portions between said maximum spaced apart relationship and said abutting relationship, said connecting means permitting relative pivotal movement of said connected adjacent portions in said maximum spaced apart relationship.

11. A shelter as claimed in claim 10, wherein said connecting means of said at least one structural member is formed to connect said adjacent end portions together in chain-like, end-to-end relation.

12. A shelter as claimed in claim 11, wherein said permitting means comprises an eyelet having an eccentric opening on each pair of adjacent end portions and said preventing means comprises stop means, received by said eyelet, on the other end portion of each of said pairs of adjacent end portions.

13. A shelter as claimed in claim 11, wherein said at least one structural member is fabricated from a plastic material and said cable is constructed from a non-metal whereby said shelter is substantially invisible to radar.

14. A shelter as claimed in claim 11, wherein said at least one structural member is attached to said cover whereby said cover positions said member for the erection thereof.

15. A shelter as claimed in claim 11, wherein said body portions of said members have a predetermined curvature.

16. A shelter as claimed in claim 11, comprising two of said structural members arranged as beams and six of said members arranged as arches.

17. A shelter as claimed in claim 11, comprising two of said structural members arranged as beams and two of said members arranged as arches.

18. A shelter as claimed in claim 11, comprising four structural members arranged as beams and three members arranged as arches.

19. A shelter as claimed in claim 11, comprising one structural member in a circular arrangement and four members arranged as arches.

20. A composite, collapsible support beam adapted to be erectable from a collapsed position to a rigid, compressed position, said beam comprising:

at least two beam elements including structural members adapted to assume a rigid, erect condition form a collapsed condition;

at least one brace element, including another of said structural members, for connecting said beam elements;

a plurality of tensionable cables for erecting said structural members, each of said structural members receiving one of said tensionable cables; and an element connected to a longitudinal end of said composite beam for extending said beam by momentum of said element.

21. A composite collapsible support beam adapted to be erectable from a collapsed position to a rigid, compressed position, said beam comprising:

at least two beam elements including structural members adapted to assume a rigid, erect condition from a collapsed condition, each of said structural members further comprising a plurality of segmental sections each having a body portion terminating in opposing end portions and connecting means on said end portions for connecting adjacent end portions of adjacent segmental sections, for defining a maximal spacing between said adjacent end portions, and for permitting said adjacent end portions to move between a maximum spaced-apart relationship and an abutting relationship;

at least one brace element, including another of said structural members, for connecting said beam elements; and a plurality of tensionable cables for erecting said structural members, each of said structural members receiving one of said tensionable cables.

22. A composite beam as claimed in claim 21, wherein said connecting means comprises an eyelet having an eccentric opening on one end portion of each pair of adjacent end portions and stop means, received by said eyelet on the other end portion of each of said pairs of end portions.

23. A composite beam as claimed in claim 22, wherein said segmental sections are formed as I-beams.

24. A composite beam as claimed in claim 23, further comprising an element connected to a longitudinal end of said composite beam for extending said beam by momentum of said element.

25. A composite beam as claimed in claim 18, wherein said structural members include a plurality of segmental sections and connecting means for connecting said sections, said connecting means including an eyelet having an eccentric opening on one of each pair of adjacent segmental sections and stop means, received by said eyelet on the other of said sections.

26. A composite beam as claimed in claim 25, wherein said segmental sections are formed as I-beams.

* * * * *